US007219746B2

(12) United States Patent
Nobileau

(10) Patent No.: US 7,219,746 B2
(45) **Date of Patent: *May 22, 2007**

(54) APPARATUS AND METHOD FOR INSTALLING A BRANCH JUNCTION FROM A MAIN WELL

(75) Inventor: Philippe C. Nobileau, 2 Avenue Fernand Martin, 06230 Villefranche/Mer (FR)

(73) Assignee: Philippe C. Nobileau, Villefranche (FR)

( * ) Notice: Subject to any disclaimer, the term of this patent is extended or adjusted under 35 U.S.C. 154(b) by 107 days.

This patent is subject to a terminal disclaimer.

(21) Appl. No.: 10/794,441

(22) Filed: Mar. 5, 2004

(65) Prior Publication Data

US 2004/0168809 A1 Sep. 2, 2004

Related U.S. Application Data

(63) Continuation-in-part of application No. PCT/IB98/01394, filed on Sep. 8, 1998.

(51) Int. Cl.
*E21B 7/06* (2006.01)

(52) U.S. Cl. ..... 166/381; 166/50; 166/117.6; 166/207; 166/242.1

(58) Field of Classification Search ..... 166/50, 166/117.6, 313, 381, 242.1, 242.2
See application file for complete search history.

(56) References Cited

U.S. PATENT DOCUMENTS

| | | | | |
|---|---|---|---|---|
| 2,397,070 A | | 3/1946 | Zublin | 166/50 |
| 2,797,893 A | | 7/1957 | McCune et al. | 166/50 |
| 3,489,220 A | | 1/1970 | Kinley | 166/277 |
| 5,318,122 A | | 6/1994 | Murray et al. | 166/313 |
| 5,330,007 A | | 7/1994 | Collins et al. | 166/313 |
| 5,337,823 A | | 8/1994 | Nobileau | 166/277 |
| 5,388,648 A | | 2/1995 | Jordan, Jr. | 166/380 |
| 5,425,559 A | | 6/1995 | Nobileau | 285/330 |
| 5,458,209 A | | 10/1995 | Hayes et al. | 175/61 |
| 5,464,062 A | | 11/1995 | Blizzard, Jr. | 166/376 |
| 5,477,925 A | | 12/1995 | Trahan et al. | 166/277 |
| 5,520,252 A | | 5/1996 | McNair | 166/313 |
| 5,526,880 A | | 6/1996 | Jordan, Jr. et al. | 166/291 |
| 5,564,503 A | | 10/1996 | Longbottom et al. | 166/313 |
| 5,680,901 A | | 10/1997 | Gardes | 166/50 |
| 5,794,702 A | | 8/1998 | Nobileau | 166/380 |
| 5,875,847 A | | 3/1999 | Forsyth | 166/313 |
| 5,944,107 A | | 8/1999 | Ohmer | 166/313 |
| 5,964,288 A | * | 10/1999 | Leighton et al. | 166/207 |
| 5,979,560 A | | 11/1999 | Nobileau | 166/381 |

(Continued)

FOREIGN PATENT DOCUMENTS

| | | |
|---|---|---|
| EP | 795 679 | 9/1997 |

(Continued)

*Primary Examiner*—Hoang Dang

(57) ABSTRACT

A casing junction member connects in a well between a main casing and a lateral branch casing. The junction member has an upper end section which connects to the main casing extending above the member. It has a lower end section that is coaxial and connects into the main casing below the junction member. The junction member has a lateral section which extends downward for connecting to lateral branch casing. The junction between the main section and the lateral section has enlarged sections that are formed by opposed cones. A removable or drillable closure member blocks the lateral passage while in the collapsed and expanded positions. The casing junction uses internal fluid pressure to move from collapsed position to expanded position.

24 Claims, 7 Drawing Sheets

U.S. PATENT DOCUMENTS

| | | | | |
|---|---|---|---|---|
| 6,024,135 | A | 2/2000 | Nobileau | 138/134 |
| 6,056,059 | A | 5/2000 | Ohmer | 166/313 |
| 6,062,314 | A | 5/2000 | Nobileau | 166/368 |
| 6,079,495 | A | 6/2000 | Ohmer | 166/313 |
| 6,089,320 | A * | 7/2000 | LaGrange | 166/313 |
| 6,142,236 | A | 11/2000 | Brammer et al. | 166/358 |
| 6,253,852 | B1 | 7/2001 | Nobileau | 166/313 |
| 6,302,212 | B1 | 10/2001 | Nobileau | 166/368 |
| 6,336,507 | B1 * | 1/2002 | Collins | 166/313 |
| 6,863,130 | B2 | 1/2003 | Steele et al. | 166/380 |
| 6,772,841 | B2 * | 8/2004 | Gano | 166/313 |
| 6,915,855 | B2 | 7/2005 | Steele et al. | 166/313 |
| 6,935,422 | B2 | 8/2005 | Steele et al. | 166/50 |
| 2003/0205379 | A1 | 11/2003 | Steele et al. | 166/313 |
| 2004/0154810 | A1 | 8/2004 | Nobileau | 166/381 |
| 2004/0182579 | A1 | 9/2004 | Steele et al. | 166/313 |
| 2005/0087345 | A1 | 4/2005 | Steele et al. | 166/384 |
| 2005/0115713 | A1 | 6/2005 | Restarick et al. | 166/313 |
| 2005/0173121 | A1 | 8/2005 | Steele et al. | 175/5 |

FOREIGN PATENT DOCUMENTS

| | | |
|---|---|---|
| WO | WO 96/22452 | 7/1996 |
| WO | WO 96/23953 | 8/1996 |
| WO | WO 97/06345 | 2/1997 |
| WO | WO 99/04135 | 1/1999 |

* cited by examiner

APPARATUS AND METHOD FOR INSTALLING A BRANCH JUNCTION FROM A MAIN WELL

This application is a continuation of International Application PCT/IB98/01394, filed Sep. 8, 1998, which is a continuation of U.S. application Ser. No. 09/148,667, filed Sep. 4, 1998, now abandoned, which is a continuation-in-part of U.S. application No. 08/925,971, filed Sep. 9, 1997, now U.S. Pat. No. 5,979,560.

TECHNICAL FIELD

This invention relates in general to the construction of a lateral branch for a primary well and particularly to a junction member which sealingly connects the main borehole casing and the branch liner casing.

BACKGROUND ART

In recent years, well construction technology has yielded substantial increases in well productivity with the spread of horizontal drilling for the bottom end section of the well. Unfortunately horizontal drilled wells provide limited zonal isolation and do not always permit good completion practices regarding the independent production of different production zones. Research efforts are now concentrating on the possibility of drilling lateral branches either inclined or horizontal from a primary well to enhance further reservoir productivity. Also lateral branches open the potential of tapping several smaller size reservoirs spread around from one single well without the need to sidetrack and redrill the well when moving the production from one production zone to the next. The challenge with multilateral completion is to install a junction apparatus having adequate internal and external pressure capability without relying only on the strength of the local rock formations.

Prior art junction apparatus designs are based on a low angle side branch casing connected to a window on the main borehole casing. Prior proposals generally require in situ milling of a window or a section in the main borehole casing. Milling steel casing downhole is a difficult task. Also, while there are numerous proposals for sealing the branch liner casing to the window, improvements are needed. One design deforms a complete junction assembly to offer a diameter equal or less than the diameter of the main borehole casing and expanding it in situ to the full cylindrical shape. In that design, the junction assembly may be elastomeric or memory metal. WO 97/06345 illustrates such a design. The junction assembly is expanded within an enlarged section of the well.

Due to the side window based connecting link between the main borehole casing and the branch outlet, all these configurations offer poor internal pressure capacity and even more limited collapse capability when the junction is located in unconsolidated or weakly consolidated formations. The poor internal pressure capability and resistance to collapsing exists even when they are fully cemented since cement does not work well in traction. It is therefore highly desirable to have a junction apparatus offering good internal pressure and collapse capability to permit a wide freedom in the location of lateral junction independent from the strength of the cementing job and/or surrounding rock formation.

DISCLOSURE OF INVENTION

In this invention, a casing junction member or apparatus is provided with an upper end which connects into the main casing. A lower main end connects to the lower main casing extending into the well. The junction apparatus has a lateral branch section which is at an angle relative to the longitudinal axis of the main section.

The lateral and lower enlarged sections join each other at a junction which has a lower perimeter portion that is generally in the shape of parabola. In one embodiment, a stiffening plate or rib is located at this junction. The plate is located in a plane of the perimeter portion and is joined between the lateral and lower enlarged sections.

Preferably the junction apparatus has an upper enlarged section which is conical and joins the upper end section of the main section. The conical upper enlarged section diverges in a downward direction. A conical lower enlarged section joins the lower end of the upper enlarged section and extends downward to the lower end section of the main section. The conical lower enlarged section diverges in a downward direction. A generally conical lateral section joins the upper enlarged section also and extends downward to the lower end section of the lateral section. The conical lateral section also converges in a downward direction. The conical lower enlarged and lateral sections are truncated. Only their inner sides join each other at the junction.

In the preferred method of installation, the junction apparatus is of steel and is plastically deformable from a collapsed position to a set position. In the collapsed position, the junction apparatus has a diameter no greater than the main casing collar. The main bore is drilled and underreamed at an intersection depth. The junction apparatus is connected to the main casing and lowered into the well with the main casing. After reaching the underreamed section, fluid pressure is applied to the main casing to cause the junction apparatus to move to the set configuration. Then the main casing is cemented in place, with the cement also flowing around the junction apparatus in the underreamed section of the borehole. Subsequently, the lateral bore is drilled and a lateral casing liner installed and sealed to the lateral section of the junction member.

BEST MODE FOR CARRYING OUT THE INVENTION

Figure 1:
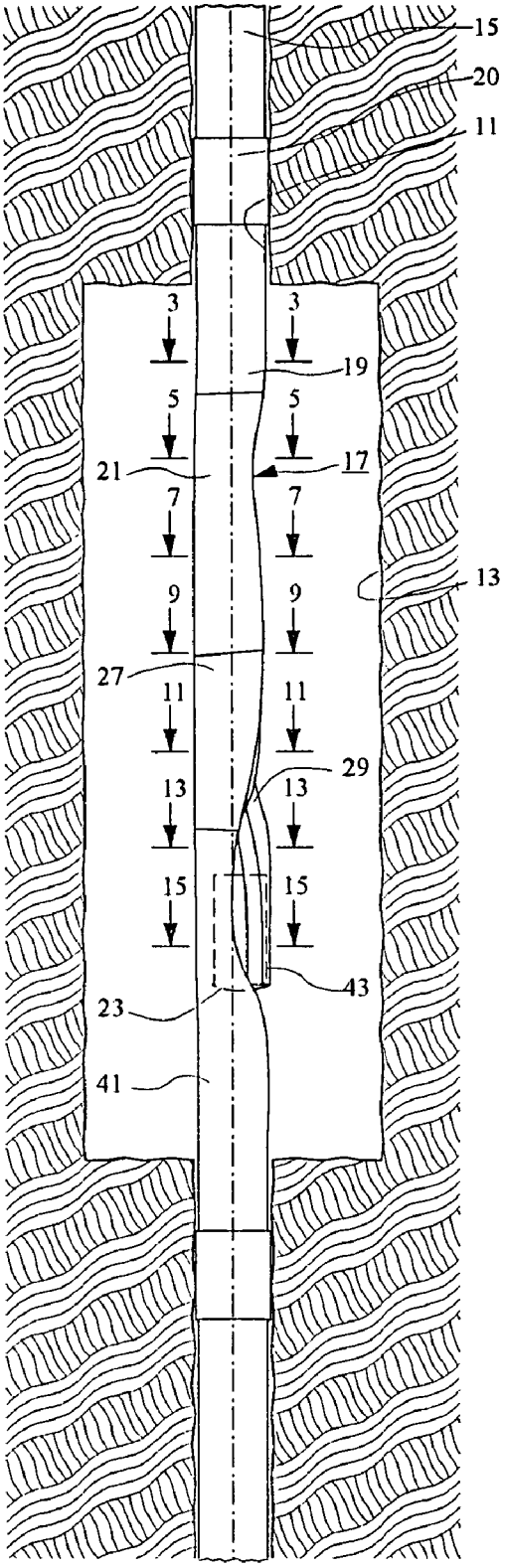
FIG. 1 is a side elevational view illustrating a junction apparatus connected into a main string of casing and shown in a collapsed position.

Referring to FIG. 1, a main bore 11 has been drilled. At a desired intersection depth, an enlarged diameter section 13 is created by underreaming. A string of main casing 15 has been run into main bore 11 through enlarged section 13. Enlarged section 13 is created at a desired intersection depth to start a lateral branch bore.

A first embodiment of a junction member 17 is connected into main casing 15 at the surface and lowered into enlarged section 13 while running casing 15. Junction member 17 is in a collapsed position while running in, as shown in FIG. 1. Subsequently, it will be expanded by internal fluid pressure to the set position in FIG. 2. Junction member 17 is of steel of a high elongation grade which is capable of being plastically deformed into the collapsed position and expanded under fluid pressure to the set position.

Figure 6:
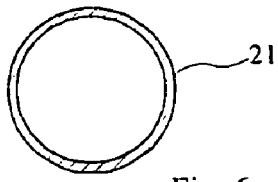
FIG. 6 is a sectional view similar to FIG. 5, but taken along the line 6—6 of FIG. 2 to show the apparatus in the set position.
Figure 7:
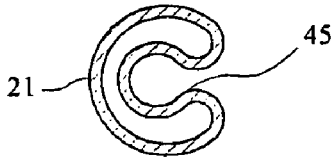
FIG. 7 is a sectional view of the junction apparatus of FIG. 1, taken along the line 7—7 of FIG. 1.
Figure 8:
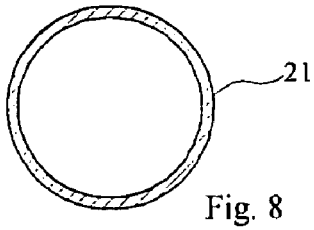
FIG. 8 is a sectional view similar to FIG. 7, but taken along the line 8—8 of FIG. 2 to show the apparatus in the set position.
Figure 9:
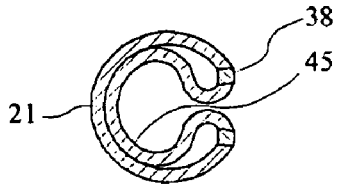
FIG. 9 is a sectional view of the junction apparatus of FIG. 1, taken along the line 9—9 of FIG. 1.

Junction member 17 includes an upper end section 19 which is secured to a casing collar 20 of main casing 15. Upper end section 19 is a cylindrical section which is coaxial with a main bore axis 23. An upper enlarged section 21 is joined to upper end section 19, preferably by welding. Upper enlarged section 21 is a conical member which diverges or increases in diameter in a downward direction, as can be seen by comparing FIGS. 6 and 8 and viewing FIGS. 18 and 19. Upper enlarged section 21 is a right circular cone generated about an axis 22. Cone axis 22 intersects and is inclined at a slight angle relative to main bore axis 23. Similarly, a lateral branch axis 25 is inclined slightly and intersects main bore axis 23 at the same point of intersection as cone axis 22. Cone axis 22 is one-half the angle of intersection of lateral axis 25. The angles of intersections may differ from well to well, and in the embodiment shown, lateral axis 25 is at a 10 deg. angle relative to main axis 23, while cone axis 22 is at a 5 deg. angle. The upper section of the lateral branch wellbore (not shown) will be drilled along lateral axis 25.

A lower enlarged conical section 27 joins the lower end of upper enlarged section 21, such as by welding. Lower enlarged conical section 27 is also a right circular cone that is slightly tilted relative to main axis 23. When viewed in the elevational view of FIG. 2, the left sides of conical upper enlarged section 21 and lower enlarged section 27 appear flush with each other and in a straight line with a side of main casing 15. Lower enlarged conical section 27 diverges in a downward direction, having a decreasing diameter as shown in FIGS. 18 and 19.

A lateral conical section 29, identical to lower enlarged conical section 27, also joins upper enlarged section 21, such as by welding. Lateral conical section 29 is also a section of right circular cone which is tilted relative to main axis 23 and lateral axis 25. When viewed in the elevational view of FIG. 2, a right side portion of lateral conical section 29 appears flush with a right side section of upper enlarged section 21 and parallel to lateral axis 25. Lateral conical section 29 also diverges in a downward direction, having a decreasing diameter as shown in FIG. 18.

Figure 17:
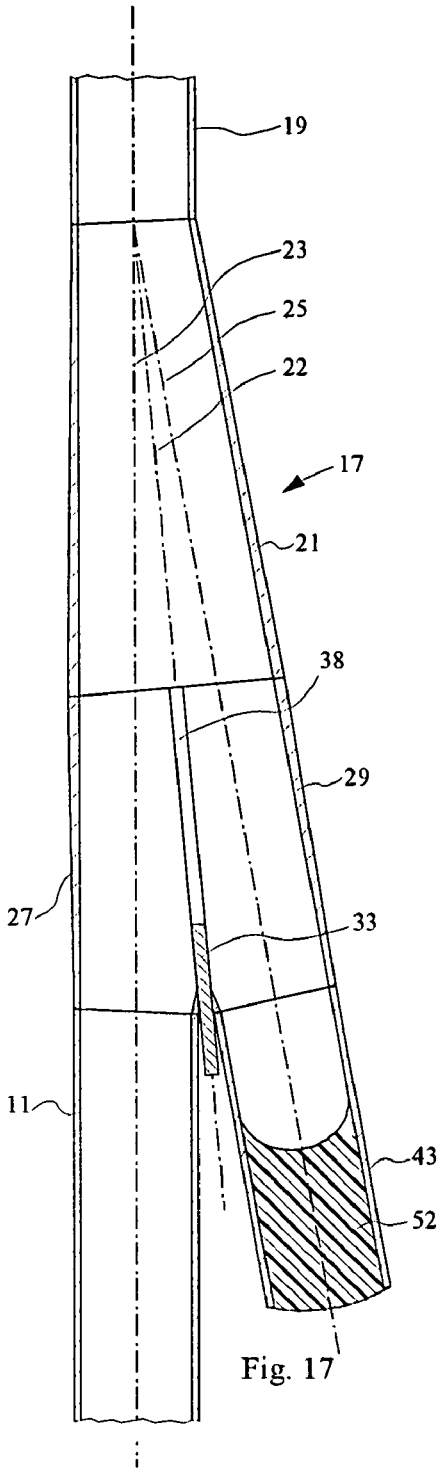
FIG. 17 is an enlarged vertical sectional view of the junction apparatus of FIG. 1, shown in the set position.
Figure 18:
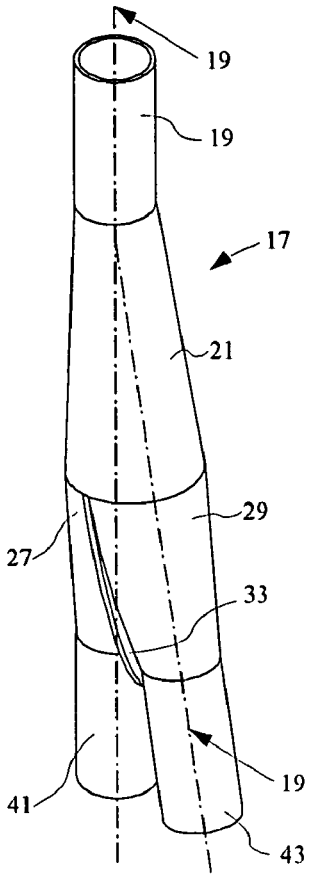
FIG. 18 is a perspective view of the junction apparatus of FIG. 1.
Figure 19:
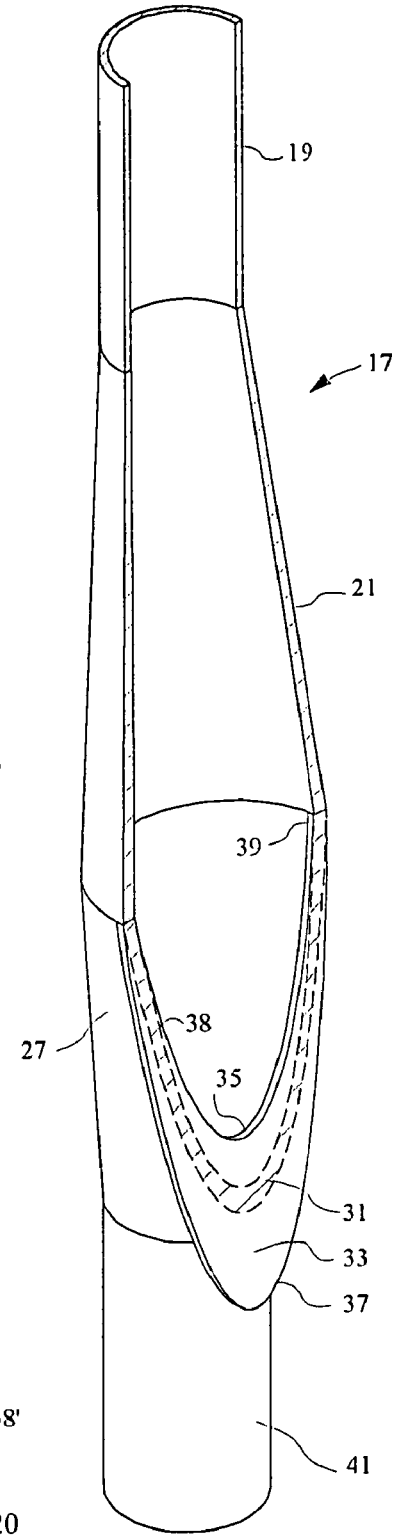
FIG. 19 is a sectional view of the junction apparatus of FIG. 1, taken along the line 19—19 of FIG. 18.

Referring to FIGS. 17–19, inner side portions of lower enlarged conical section 27 and lateral conical section 29 are cut or truncated to form a junction of the two sections. This junction has a lower perimeter portion 31 that is in a configuration of a parabola. Lower perimeter portion 31 comprises mating edges of lower enlarged and lateral conical section 27, 29, the edges being abuttable with each other.

Lower perimeter portion 31 is contained in a plane that contains cone axis 22.

In the first embodiment, a stiffening plate or rib 33 is sandwiched between the conical lower enlarged and lateral sections 27, 29 at lower perimeter portion 31. Stiffening plate 33 is also in the general configuration of a parabola. In the embodiment shown, it has an inner edge 35 that is in the configuration of a parabola. Outer edge 37 is also in the configuration of a parabola. However, the parabola of inner edge 35 is not as steep, with edges 35, 37 converging toward each other in an upward direction. This results in legs 38 for stiffening plate 33 that decrease in width in an upward direction until reaching a minimum width at upper ends 39. Upper ends 39 of stiffening plate 33 are located at the lower end of upper enlarged section 21. The width between inner edge 35 and outer edge 37 is the smallest at this point. The maximum width of plate 33 is at its lowest point.

Stiffening plate 33 is welded to lower enlarged and lateral conical members 27, 29 at junction 31. In this position, inner edge 35 is located above lower perimeter portion 31, while outer edge 27 is located below lower perimeter portion 31. Stiffening plate 33 is located in a plane of lower perimeter portion 31. Conical axis 22 passes through a plane containing stiffening plate 33.

Figure 10:
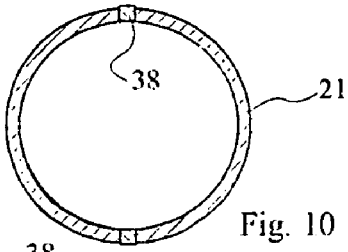
FIG. 10 is a sectional view similar to FIG. 9, but taken along the line 10—10 of FIG. 2 to show the junction apparatus in the set position.
Figure 12:
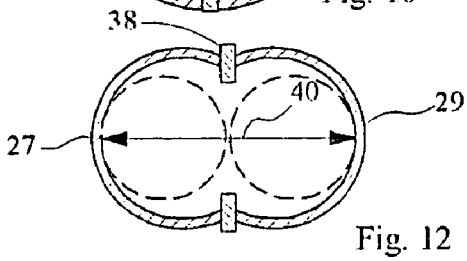
FIG. 12 is a view similar to FIG. 11, but taken along the line 12—12 of FIG. 2 to show the junction apparatus in the set position.

The purpose of stiffening plate 33 is to reinforce the junction between lower enlarged and lateral conical sections 27, 29. Referring to FIGS. 10 and 12, internal pressure within junction member 17 will tend to cause junction member 17 to assume a circular configuration. The circular configuration is desired at the lower edge of upper enlarged section 21 as shown in FIG. 10. However, the junction of the lower enlarged and lateral conical sections 27, 29 with upper enlarged section 21 is not circular, as shown in FIG. 12. In FIG. 12, which is a section taken about halfway down the joined lower enlarged and lateral conical sections 27, 29, the joined conical sections will have a cross-sectional configuration that is not circular. Rather, the distance 40 between outer sides of the lower enlarged and lateral conical sections 27, 29 perpendicular to a line extending between legs 38 is substantially greater than the distance between the two legs 38 of stiffening plate 33 at that point. The cross-section presents a general peanut shape, with the dotted lines in FIG. 12 representing the full bore access to the lower ends of the main and lateral branches. Without stiffening plate 33, internal pressure would tend to force the small dimension portion between legs 38 apart to the circular configuration as in FIG. 10. This would deform the junction and restrict the full bore access to both branches. Stiffening plate 33 prevents such occurrence at test pressure levels.

Referring again to FIG. 2, a cylindrical main section lower end 41 joins the lower end of lower enlarged conical section 27, which is circular at that point. The main section lower end 41 is secured to the lower continuation of main casing 15 by a threaded collar. Lower end 41 is coaxial with main axis 23. Similarly, cylindrical lateral end portion 43 joins the lower end of lateral conical section 29, which is circular at that point. Lateral section 43 extends downward and provides a guide for drilling a lateral branch borehole (not shown) Lateral end section 43 is coaxial with lateral axis 25. Stiffening plate 33 extends downward a short distance between main section lower end 41 and lateral section lower end 43.

Junction member 17 if first constructed and tested in the set configuration, then will be formed in the collapsed configuration that is shown in FIG. 1. In the collapsed configuration, the overall diameter is substantially the same as the diameter of main casing 15 and no greater than the outer diameter of casing collar 20. Referring to FIG. 1 and FIGS. 3, 5, 7, 9, 11, 13 and 15, the collapsed configuration has a doubled back section 45 within upper enlarged section 21. Doubled back section 45 increases in extent in a downward direction as shown by comparing FIG. 5, FIG. 7 and FIG. 9.

Figure 11:
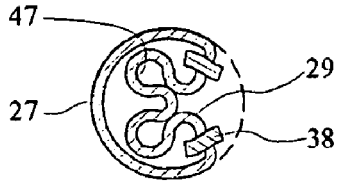
FIG. 11 is a sectional view of the junction apparatus of FIG. 1, taken along the line 11—11 of FIG. 1.
Figure 13:
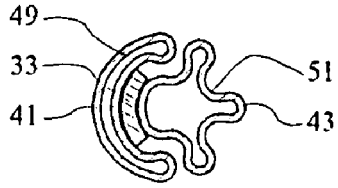
FIG. 13 is a sectional view of the junction apparatus of FIG. 1, taken along the line 13—13 of FIG. 1.
Figure 14:
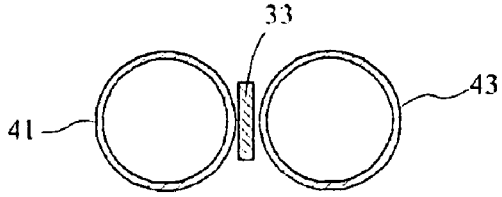
FIG. 14 is a sectional view similar to FIG. 13, but taken along the line 14—14 of FIG. 2 to show the junction apparatus in the set position.

As shown in FIG. 11, lower enlarged conical section 27 remains generally undeflected. However, lateral conical section 29 is folded into the interior of lower enlarged conical section 27. In the position shown, two loops 47 are employed to accommodate the full extent. Note that legs 38 will not be in a common plane in the collapsed position. In FIG. 13, an inner side 49 of main lower end 41 is doubled back into an outer side section of main lower end 41, presenting a crescent shape.

Figure 15:
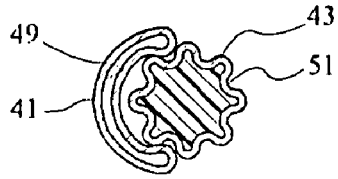
FIG. 15 is a sectional view of the junction apparatus of FIG. 1, taken along the line 15—15 of FIG. 1.
Figure 16:
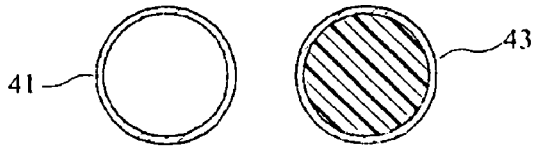
FIG. 16 is a sectional view similar to FIG. 15, but taken along the line 16—16 of FIG. 2 to show the junction apparatus in the set position.

A plurality of axially extending channels 51 are formed in the upper section of lateral section lower end 43. Stiffening plate 33 is bent into a concave configuration at its lower section. Referring to FIG. 15, more vertical channels 51 will be present on lateral section lower end 43, and they will be symmetrical to form a corrugated configuration for lateral section lower end 43. The crescent configuration remains for main section lower end 41 for a short distance downward where it again returns to a cylindrical configuration as shown in FIG. 1. In the collapsed position, lateral end section 43 extends downward generally parallel with main axis 23.

In operation, main bore 11 will be drilled, then one or several enlarged sections 13 are created. The operator inserts one or several junction members 17 into main casing 15 while in the collapsed position and runs main casing 15. Main casing 15 will have a conventional cementing shoe (not shown) on its lower end. The cement shoe will be of a type which prevents downward flow until a dart or ball is dropped to shift a valve member. Lateral end 43 has a plug 52 which seals both while lateral end 43 is in the corrugated shape and in the set position.

When junction member 17 reaches enlarged bore section 13, the operator will apply pressure to casing 15. The internal pressure causes junction member 17 to plastically deform from the collapsed position shown in FIG. 1 to the set position shown in FIG. 2. The operator then drops a ball or dart to shift cement shoe to a position wherein fluid may be pumped downward in main casing 15. The operator then pumps cement down main casing 15, which flows out the cement shoe and back up an annulus in main bore 11 surrounding main casing 15. The cement will flow through the enlarged section 13 and up toward the surface. Drilling fluid will be pumped down behind the cement to flush main bore casing 15 of cement. A cement wiper plug (not shown) separates the cement from the drilling fluid, the plug moving downward through junction member 17 to the lower end of main bore casing 15.

The operator may then perform further drilling through main casing 15. When the operator wishes to drill the lateral branch, he will either install a whipstock in the main borehole or use a kick-out device to deflect the drill bit over into the lateral section. The operator drills out plug 52 and continues drilling at lateral angle 25 for a selected distance into the earth formation. Once a desired depth has been reached for the lateral branch, the operator will run a liner casing (not shown). The liner casing will have a conventional hanger and seal for hanging and sealing within lateral section lower end 43. The lateral liner casing will be cemented in a conventional manner.

Figure 20:
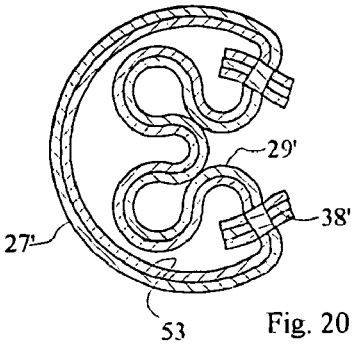
FIG. 20 is a sectional view similar to FIG. 11, but showing an alternate embodiment of the junction apparatus.
Figure 21:
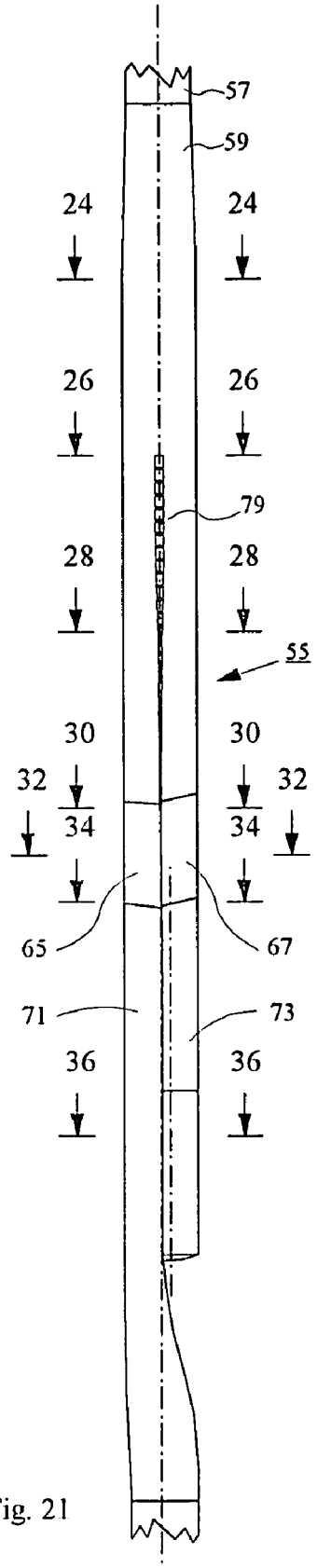
FIG. 21 is a side view of another embodiment of a junction apparatus constructed in accordance of this invention and shown in the collapsed position.

FIG. 20 illustrates an alternate embodiment in which the walls of the junction apparatus are formed with multiple plies, each being metal, to facilitate expansion from the collapsed position to the set position. For example, FIG. 20 shows an inner wall or ply 53 located within an outer ply or wall of conical members 27' and 29'. The stiffening plate is also formed of multiple plies as indicated by legs 38'. The total thickness of the two plies should be substantially no greater than that of a single wall which has the same pressure rating. The use of two walls for the various components of junction member 17 reduces the amount of strain that would otherwise occur during plastic deformation with a single wall having the same total thickness as the two plies.

Figure 2:
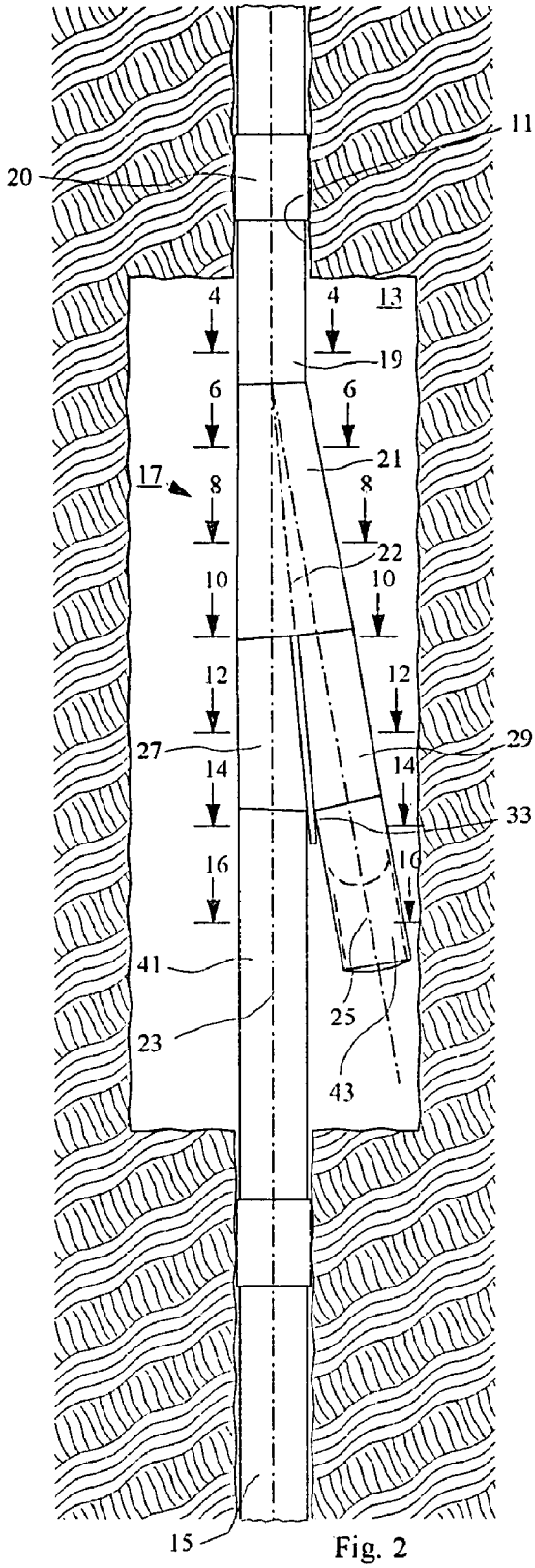
FIG. 2 is a side elevational view similar to FIG. 1, but showing the junction apparatus expanded to a set position.
Figure 3:
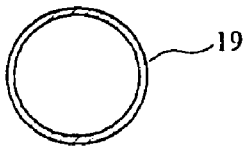
FIG. 3 is a sectional view of the junction apparatus of FIG. 1, taken along the line 3—3 of FIG. 1.
Figure 4:
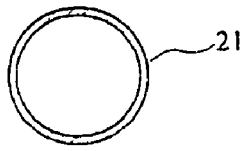
FIG. 4 is a sectional view similar to FIG. 3, but taken along the line 4—4 of FIG. 2 to show the apparatus in the set position.
Figure 5:
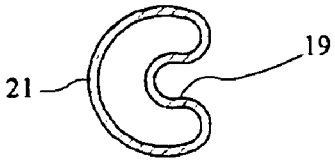
FIG. 5 is a sectional view of the junction apparatus of FIG. 1, taken along the line 5—5 of FIG. 1.
Figure 22:
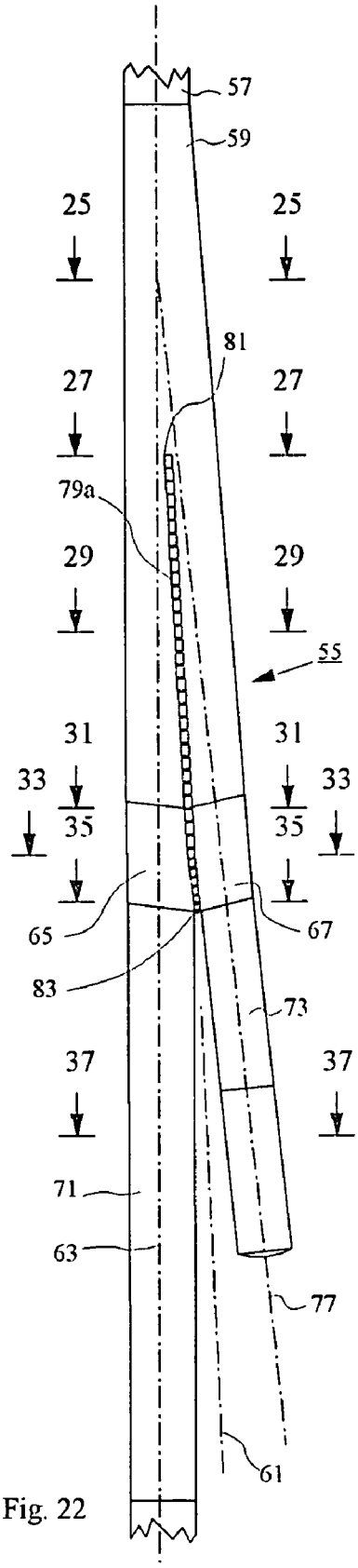
FIG. 22 is a side view of the junction apparatus of FIG. 21, shown in the set position.

FIGS. 21–40 illustrate another embodiment of a junction member, with the principal difference between junction member 55 does not use a stiffening plate such as stiffening plate 33 (FIG. 2). Referring to FIG. 22, junction member 55 has an upper end section 57 that is cylindrical and of the same diameter as a main string of casing (not shown) for attachment to the main string of casing. A conical upper enlarged section 59 has an upper end welded to the lower end of upper end section 57. Upper enlarged section 59 diverges in a downward direction, resulting in a greater diameter at its lower end at section line 31 than at its upper end above section line 25. Upper enlarged section 59 has an axis 61 which is inclined relative to main casing axis 63.

A conical lower enlarged section 65 has an upper end welded to part of the lower end of upper enlarged section 59. Conical lower enlarged section 65 is much shorter in length than the length of upper enlarged section 59. Conical section 65 converges in a downward direction, as can be seen by comparing FIGS. 33 and 35, and comprises one-half of a cone with a diameter at its lower end that is substantially the same as the diameter of the upper end section 57.

Figure 33:
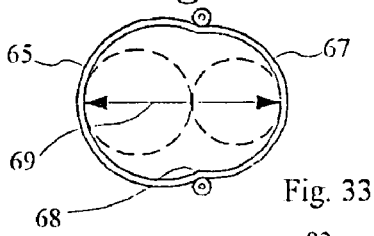
FIG. 33 is a sectional view of the junction apparatus of FIG. 21, taken along the line 33—33 of FIG. 22.

A conical lateral section 67 also joins the lower end of upper enlarged section 59. Conical lateral section 67 is the same length as conical lower enlarged section 65, but of a lesser diameter. Referring to FIG. 33, conical lateral section 67 forms the right half of junction member 55 at section line 33, with conical lower enlarged section 65 forming the left half at that point. Conical lower enlarged section 65 and lateral section 67 are truncated and abutted along their inner edges 68, the inner edges 68 being in a plane which contains axis 61 of upper enlarged section. Inner edges 68 of the conical lower enlarged section 65 and conical lateral section 67 are welded together.

In the first embodiment, a stiffening plate 33 is located between the inner edges, while in this embodiment, it is not required due to the relatively short lengths of conical lower enlarged and lateral sections 65, 67. As shown in FIG. 33, the shape of junction member 55 at that point is somewhat in the shape of a peanut, with a major dimension 69 that is greater than a minor dimension measured perpendicular to line 69 at the midpoint of line 69.

Referring again to FIG. 22, a lower main section 71 of cylindrical configuration is welded to the lower end of conical lower enlarged section 65. Lower main section 71 joins main casing (not shown) extending below and is coaxial with upper main section 57 and main axis 63. A lower lateral section 73 of cylindrical configuration is welded to the lower end of conical lateral section 67. Lower lateral section 73 will receive a string of lateral liner (not shown). Junction member 55 while in the expanded position resembles an inverted "Y". A drillable plug 75 is secured in lower lateral section 73. The diameter of lower lateral section 73 is smaller than the diameter of lower main section 71. Lower lateral section 73 is located on a lateral branch axis 77 which is at an acute angle relative to main casing axis 63. Upper enlarged section axis 61 bisects axes 63 and 77, with all three axes 61, 63, 77 being in a single plane.

Figure 23:
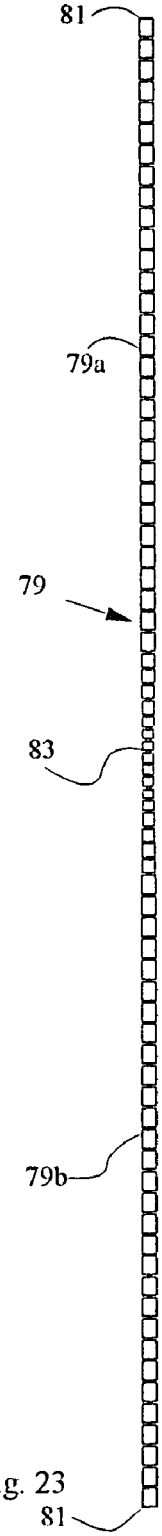
FIG. 23 is an enlarged side view of a segmented rod employed with the junction apparatus of FIG. 21.
Figure 24:
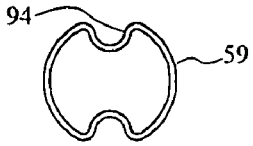
FIG. 24 is a sectional view of the junction apparatus of FIG. 21, taken along the line 24—24 of FIG. 21.
Figure 25:
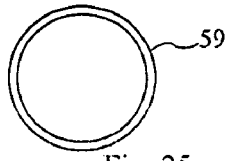
FIG. 25 is a sectional view of the junction apparatus of FIG. 21, taken along the line 25—25 of FIG. 22.

For manufacturing purposes, a segmented rod 79 is secured to junction apparatus 55. Segmented rod 79 has two portions 79*a*, 79*b*, each located on the exterior of junction member 55 180 deg. apart from the other. Segmented rod portions 79*a*, 79*b* are identical and are used when deforming junction member 55 from the set position of FIG. 22 to the collapsed position of FIG. 21, as will be subsequently explained. FIG. 23 shows segmented rod 79 prior to installation. Each segmented rod portion 79*a*, 79*b* has an upper end 81 which is tack welded to exterior portion of junction member 55 near the upper end of upper enlarged section 59. The middle section 83 of segmented rod 79 loops under the lower end of the intersection of the conical lower enlarged section 65 and conical lateral section 67. Each segmented rod portion 79*a*, 79*b* is located in a plane that contains upper enlarged section axis 61.

Figure 38:
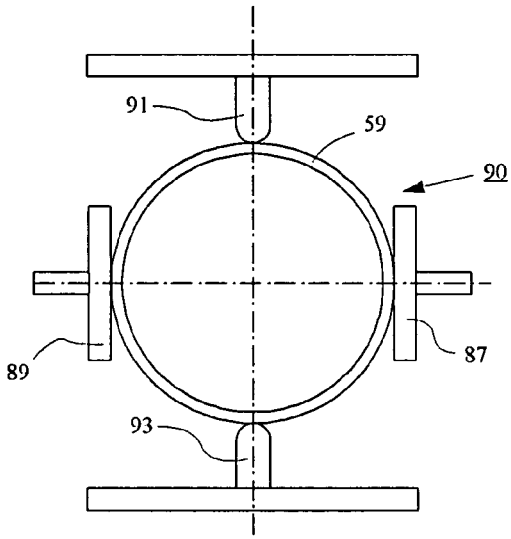
FIG. 38 is a sectional view of the junction apparatus of FIG. 21 within a folding machine in preparation for being folded, and taken along the line 38—38 of FIG. 40.
Figure 39:
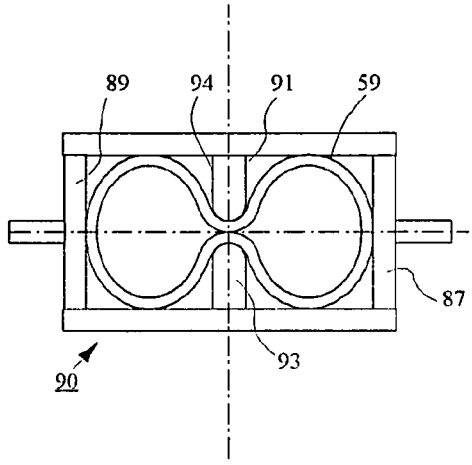
FIG. 39 is a sectional view showing the junction apparatus and folding machine of FIG. 38 after folding has occurred.
Figure 40:
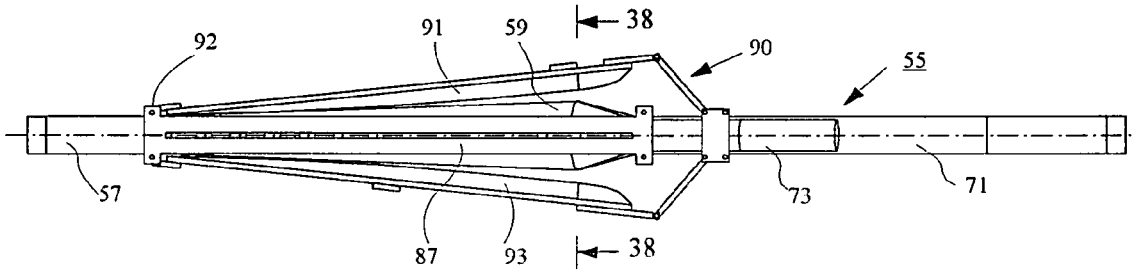
FIG. 40 is a side view of the folding machine of FIG. 38, shown prior to folding.

Junction member 55 will first be formed and tested in the expanded configuration of FIG. 22 or in the folded configuration of FIG. 39 with some external support. Then it will be collapsed to the position shown in FIG. 21 for passage into the well. Referring to FIGS. 38 and 40, in the first step, junction member 55 will be positioned on a folding machine 90 which extends from the lower end of lower lateral section 73 to upper end section 57 (FIG. 22). Folding machine 90 has two opposed convex, blunt blades 91, 93. Blades 91 are hinged together by a hinge 92 at the end near upper end section 57. Folding machine 90 has two stationary retainers or supports 87, 89. FIGS. 38 and 39 are taken at a section similar to the section shown in FIGS. 30 and 31.

For reference, assume that blades 91, 93 are at the 0 deg. and 180 deg. position, while retainers 87, 89 are stationarily mounted at the 90 deg. and 270 deg. position. The lateral leg or lower lateral section 73 will be located at the 90 deg. position and held in place by stationary support 87. Then, blades 91, 93 are moved toward each other by hydraulic force until a point on the inner diameter at the 0 deg. position contacts a point on the inner diameter at the 180 deg. position. This step folds junction member 55 into two halves, forming two concave bights 94. Note by comparing FIGS. 24, 26, 28 and 30, that blades 91, 93 do not form bights 94 of constant depth. The distance between blades 91, 93 at hinge 92 and the conical configuration of junction member 55 creates shallower bights 94 at the upper end, with the inner sides of junction member 55 touching only in the proximity of section line 31 (FIG. 22).

Figure 26:
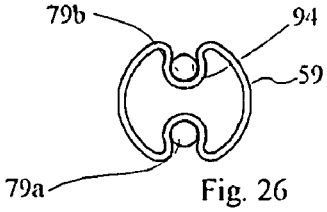
FIG. 26 is a sectional view of the junction apparatus of FIG. 21, taken along the line 26—26 of FIG. 21.
Figure 27:
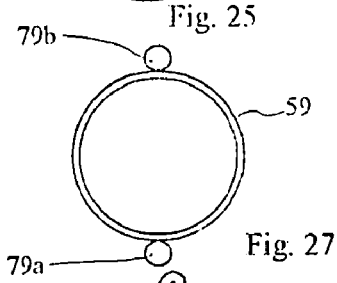
FIG. 27 is a sectional view of the junction apparatus of FIG. 21, taken along the line 27—27 of FIG. 22.
Figure 28:
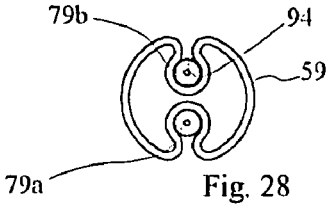
FIG. 28 is a sectional view of the junction apparatus of FIG. 21, taken along the line 28—28 of FIG. 21.
Figure 29:
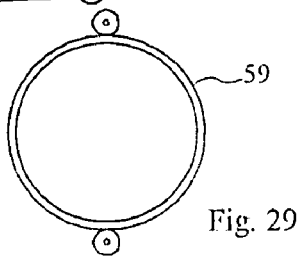
FIG. 29 is a sectional view of the junction apparatus of FIG. 21, taken along the line 29—29 of FIG. 22.
Figure 30:
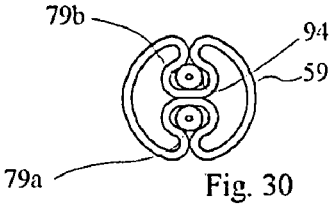
FIG. 30 is a sectional view of the junction apparatus of FIG. 21, taken along the line 30—30 of FIG. 21.
Figure 31:
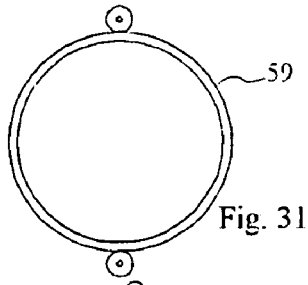
FIG. 31 is a sectional view of the junction apparatus of FIG. 21, taken along the line 31—31 of FIG. 22.
Figure 41:
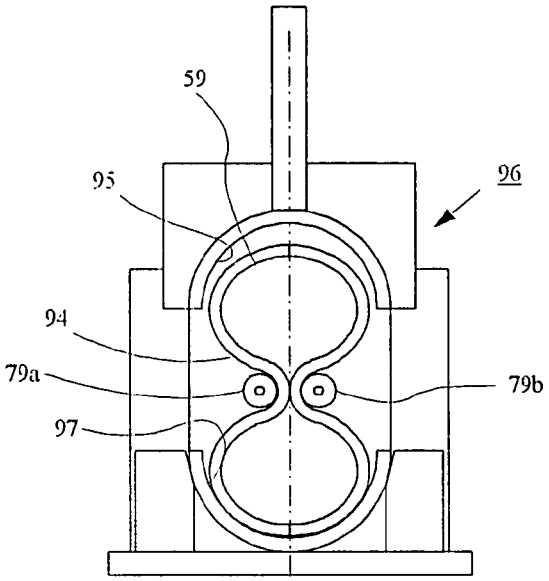
FIG. 41 is a sectional view showing the junction apparatus of FIG. 21 positioned in a collapsing machine for collapsing from the folded position of FIG. 21, and taken along the line 41—41 of FIG. 43.

Then, as shown in FIG. 41, segmented rod 79 is secured in the bights 94, with the middle portion 83 looped between lower lateral sections 73 and lower main section 71. The upper ends 81 will be tack welded in the bights 94. As shown in FIGS. 26, 28 and 30, the distance between segmented rod portions 79*a*, 79*b* gradually increases in the upward direction from the lower end of upper enlarged section 59 to the upper ends 81 generally at section line 26 (FIG. 26).

Figure 42:
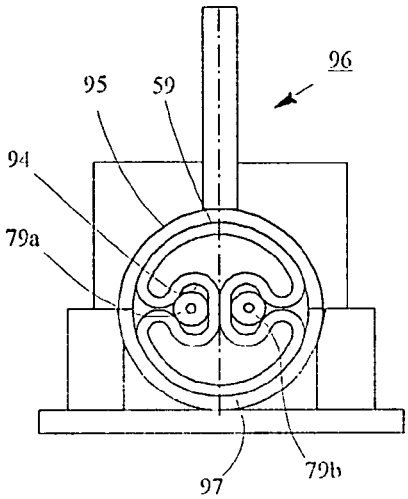
FIG. 42 is a sectional view illustrating the junction apparatus and the collapsing machine of FIG. 40 moved to the collapsed position.
Figure 43:
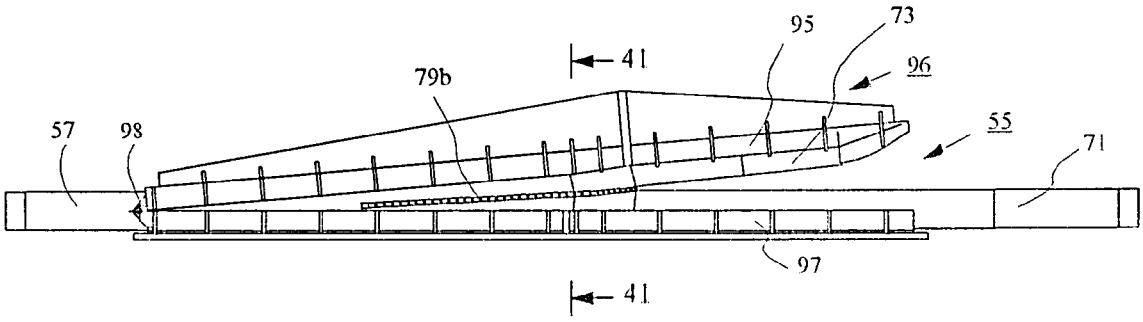
FIG. 43 is a side view of the collapsing machine of FIG. 41, shown prior to collapsing the junction apparatus.

Returning to FIGS. 41 and 43, junction member 55 is then placed in a collapsing machine 96. Collapsing machine 96 has two concave dies 95, 97 which are semicylindrical, forming a cylinder when brought together as in FIG. 42. The inner diameter of dies 95, 97 is substantially the same as the outer diameter of upper end section 19 collar 20 (FIG. 1). Concave dies 95, 97 are located at the 90 deg. and 270 deg. position and connected by a hinge 98 at the upper end as shown in FIG. 43. FIGS. 41, 42 are also shown at a section line at the lower end of upper enlarged section 59, this section line being shown in FIG. 30.

Figure 32:
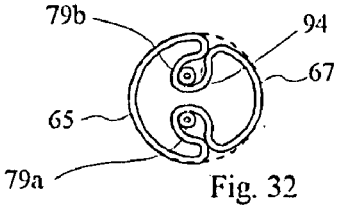
FIG. 32 is a sectional view of the junction apparatus of FIG. 21, taken along the line 32—32 of FIG. 21.
Figure 34:
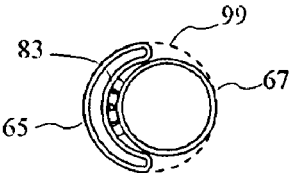
FIG. 34 is a sectional view of the junction apparatus of FIG. 21, taken along the line 34—34 of FIG. 21.
Figure 35:
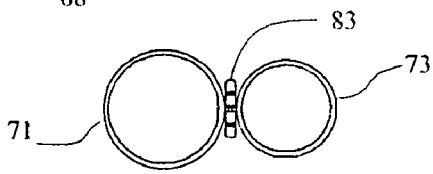
FIG. 35 is a sectional view of the junction apparatus of FIG. 21, taken along the line 35—35 of FIG. 22.
Figure 36:
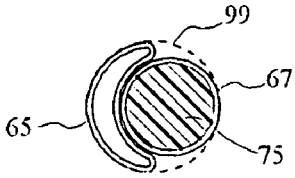
FIG. 36 is a sectional view of the junction apparatus of FIG. 21, taken along the line 36—36 of FIG. 21.
Figure 37:
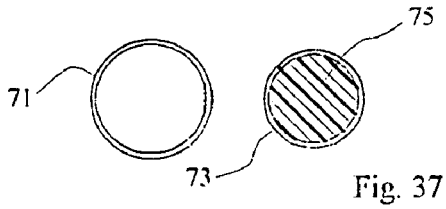
FIG. 37 is a sectional view of the junction apparatus of FIG. 21, taken along the line 37—37 of FIG. 22.

Die 95 is hydraulically moved toward die 97, causing the two lobes opposite bights 94 to collapse into configuration shown in FIG. 42. In this configuration, junction member 55 has an outer diameter, or cylindrical surface of revolution, which is no greater than collar 20 of upper end section 57 or 19. As can be seen in FIGS. 32 and 34, die 95 folds lower lateral section 73 inward into a concave depression formed in lower main section 71. Lower main section 71 will be crescent-shaped, while lower lateral section 73 remains mostly cylindrical and substantially undeflected. As shown by dotted lines 99 in FIG. 36, the surface of revolution of junction member 55 is cylindrical and no greater at any point than the outer diameter of collar 20 (FIG. 1). Segmented rod portions 79*a*, 79*b* limit strain during the bending of bights 94, preventing them from forming curved portions which are too small in radius.

Junction apparatus 55 is run and installed in the same manner as described in connection with the first embodiment. It is run in while in the collapsed position of FIG. 21. Junction member 55 will locate within a reamed out section of the borehole. Hydraulic pressure is supplied to liquid contained in the main casing and junction apparatus 59. A plug (not shown) at the cement shoe at the lower end of the main casing enables hydraulic pressure to be applied throughout the length of casing and junction apparatus 55. The pressure causes junction member 55 to expand to the set position with lateral leg 73 moving outward.

After reaching this position, a valve will be shifted at the cement shoe to enable cement to be pumped downward, which flows through the main casing and back up at annulus surrounding the main casing. When it is desired to drill the lateral well bore, the operator uses a kick-off tool or whipstock to cause bit to enter lateral leg 73, drill-out plug 75 and drill the lateral leg. Lateral casing of smaller diameter than the main casing will be run through lateral leg 73 and supported by a hanger mechanism in lateral leg 73. Lateral casing will be cemented conventionally.

The invention has significant advantages. The junction apparatus provides a good seal between the main casing and the lateral branch casing. The junction member may be run in collapsed and expanded to a set position. The method of running the junction member in with the main casing avoids a need to mill out a window or section of the main casing. In the second embodiment, there is not need to plastically deflect greatly the cylindrical part of the lateral leg, facilitating a plug to be located therein.

While the invention has been shown in only one of its forms, it should be apparent to those skilled in the art that it is not so limited, but is susceptible to various changes without departing from the scope of the invention. For instance the conical sections can be replaced by an extended stiffening plate. Also the bottom of upper enlarged section 21 can be large enough to accommodate full access to both branches side by side, and the stiffening plate inner edge 35 can be straight without any legs 38.

I claim:

1. A casing junction apparatus for joining a lateral branch casing to a string of main casing in a well, the apparatus having a collapsed position for running-in and an expanded position while installed, the apparatus comprising:

a main passage having an upper end and a lower end adapted to be secured into and run into a main well while the apparatus is in the collapsed position, and a lateral passage joining the main passage between the upper and lower ends and extending laterally therefrom; and wherein the apparatus is formed of malleable material;

wherein said main passage comprises:

a generally conical upper enlarged section which is adapted to be connected to said upper end and diverges in a downward direction, a generally conical lower enlarged section which joins the upper enlarged section or a cylindrical downward extension of it and extends downward, the conical lower enlarged section converging in a downward direction for connection to said lower end; and said lateral passage comprises a branch lateral section which joins at least one of the enlarged sections and extends downward at an angle relative to the main casing for connection to lateral branch casing below the apparatus.

2. The apparatus of claim 1, further comprising a removable or drillable, substantially cylindrical, closure member blocking the lateral passage while in the collapsed position and the expanded position.

3. The apparatus of claim 1, being formed of metal and being movable from the collapsed position to the expanded position in response to internal fluid pressure applied to the main and the blocked lateral passages.

4. The apparatus of claim 2, wherein the closure member is a drillable cement shoe.

5. The apparatus of claim 1, wherein the wall of the lateral passage is corrugated to reduce its diameter and the closure member is housed in the corrugated section.

6. The apparatus of claim 1, having a general cylindrical configuration coaxial with a main axis while it is in the collapsed position.

7. The apparatus of claim 6, having a general cylindrical diameter close to a casing collar diameter while it is in the collapsed position.

8. The apparatus of claim 1, wherein the main passage further comprises:

a cylindrical main lower end section which is adapted to be secured to the lower portion of the main casing;

and the lateral passage comprises also a cylindrical lateral lower end section which is adapted to be secured to the lateral branch casing, and wherein while in the collapsed position, the cylindrical main lower end section deforms into a doubled back configuration to receive the cylindrical lateral lower end section, which remains substantially undeflected in a generally cylindrical configuration.

9. The apparatus of claim 1, wherein at least one portion of the apparatus has a multiple ply metal wall.

10. The apparatus of claim 1, wherein the lower enlarged section and the branch lateral section are partially conical and have a junction which has a lower perimeter portion that is generally in the shape of a parabola.

11. The apparatus of claim 1, wherein the lower enlarged section and the branch lateral section are partially conical and have a junction which has a lower perimeter portion and a stiffening member, said stiffening member being located in a plane containing the lower perimeter portion of the junction.

12. A method for providing a junction in a main casing to enable a lateral branch well to be drilled therefrom, comprising:

(a) providing a metal junction apparatus which has a single generally conical upper diverging downwardly end, a main leg comprising a converging downwardly conical portion and a lateral leg comprising a converging downwardly conical portion, defining a generally inverted Y-shape;

(b) deforming the junction apparatus into a collapsed position in which the main leg portion receive the lateral leg portion;

(c) blocking the lateral leg portion with a removable or drillable closure;

(d) securing the junction apparatus into the main casing, and running the main casing and the junction apparatus into a well; and (e) pumping a liquid into the main casing at a pressure sufficient to cause the junction apparatus to expand into the inverted Y-shape, with the lateral leg portion moving laterally outward.

13. The method of claim 12, wherein step (d) further comprises closing a lower end of the main casing with a cement shoe; and wherein after step (e), the method further comprises, opening the cement shoe and pumping cement down the main casing which flows back up an annulus in the well surrounding the main casing.

14. The method of claim 12, wherein the method comprises after pumping cement down the main casing:

lowering a drill bit into the lateral leg portion;

drilling out the closure member contained therein;

drilling a lateral well through the lateral leg portion; then running a lateral string of casing through the lateral leg portion and securing an upper end of the lateral string of casing to the lateral leg portion.

15. The method of claim 12, wherein step (b) comprises:

forming opposite portions of a sidewall of the main leg portion inward into contact with each other, forming concave bights at zero and 180 degrees, with reference to the lateral leg section being at 90 degrees; then placing radius limiting rods in each bight; then bending the lateral leg section and the main leg toward each other with concave dies to form a generally cylindrical shape.

16. The method of claim 12, further comprising:

prior to installing the main casing and the junction apparatus in the well, enlarging an intersection portion of the well; and performing step (e) while the junction apparatus is in the intersection portion of the well; then after step (e), pumping a cement slurry dawn the main casing and back up an annulus surrounding the main casing and around the junction apparatus; then drilling a lateral branch wellbore through the lateral leg section of the junction apparatus; and then running lateral branch casing into the lateral branch wellbore and securing an upper end of the lateral branch casing to the lateral leg of the junction apparatus.

17. A pressure resistant casing junction apparatus for joining a lateral branch casing to a string of main casing in a well, the apparatus having a collapsed position for running in and an expanded position while installed, the apparatus comprising in the expanded position:

an intermediate portion of the junction connected to the bottom end of said main casing, having at least a substantially circular cross section;

a main portion connected to the bottom of said intermediate portion and to the top end of said main casing;

a lateral portion intersecting said main portion both said main and lateral portion having a common section that is not substantially circular in said expanded position;

wherein said substantially circular cross section has at least a dimension larger than the largest dimension of said cross section in said collapsed position and wherein said common cross section is maintained in form by stiffening means when fluid pressure is applied inside said junction.

18. The apparatus of claim 17, further comprising a removable or drillable closure member blocking the lateral portion.

19. The apparatus of claim 17, being formed of metal and being movable from the collapsed position to the expanded position in response to internal fluid pressure applied to casing junction.

20. The apparatus of claim 17, wherein at least one of said portion is at least partially made of multiple ply metal walls.

21. A method for providing a pressure resistant junction in a well between a main casing and a lateral branch casing, said junction being configurable in a collapsed position and in a expanded position, comprising:

(a) providing a junction apparatus which comprises an intermediate portion having at least a substantially circular cross section in said expanded position, a main portion connected to the bottom end of said intermediate portion and a lateral portion intersecting said main portion both lateral and main portion having a common cross section that is not circular in expanded position;

(b) lowering said junction into said well in said collapsed position;

(c) deforming said junction from a collapsed position to said expanded position so that said circular cross section has at least a dimension larger than the largest dimension of said cross section in said collapsed position and so that said common cross section is maintained in form by stiffening means when fluid pressure is applied inside said junction.

22. The method of claim 21, wherein step (a) further comprises closing a lower end of the main casing with a cement shoe; and wherein after step (c), the method further comprises, opening the cement shoe and pumping cement down the main casing which flows back up an annulus in the well surrounding the main casing.

23. The method of claim 22, further comprises, after the last step, the steps of lowering a drill bit into the lateral portion; drilling out the closure member contained therein; drilling a lateral well through the lateral portion; then running a lateral string of casing through the lateral portion and securing an upper end of the lateral string of casing to the lateral portion.

24. The method of claim 21, further comprising:

prior to installing the main casing and the junction apparatus in the well, enlarging an intersection portion of the well; and performing step (c) while the junction apparatus is in the intersection portion of the well; then after step (c), pumping a cement slurry down the main casing and back up an annulus surrounding the main casing and around the junction apparatus; then drilling a lateral branch wellbore through the lateral portion of the junction apparatus; and then running a lateral branch casing into the lateral branch wellbore and securing an upper end of the lateral branch casing to the lateral portion of the junction apparatus.

* * * * *